US007412748B2

(12) United States Patent
Lee et al.

(10) Patent No.: US 7,412,748 B2
(45) Date of Patent: Aug. 19, 2008

(54) ROBOT CLEANING SYSTEM

(75) Inventors: Jun Hwa Lee, Anyang-Si (KR); Jae Man Joo, Suwon-Si (KR); Jae Young Kwak, Incheon (KR); Gwan Woo Shin, Gwacheon-Si (KR); Hoon Wee, Yongin-Si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 51 days.

(21) Appl. No.: 11/497,291

(22) Filed: Aug. 2, 2006

(65) Prior Publication Data

US 2007/0157420 A1 Jul. 12, 2007

(30) Foreign Application Priority Data

Jan. 6, 2006 (KR) ..... 10-2006-0001922

(51) Int. Cl.
*A47L 5/00* (2006.01)
*A47L 9/28* (2006.01)

(52) U.S. Cl. ..... 15/340.1; 15/319; 15/328

(58) Field of Classification Search ..... 15/340.1, 15/340.2, 319, 328
See application file for complete search history.

(56) References Cited

U.S. PATENT DOCUMENTS

| | | | | |
|---|---|---|---|---|
| 5,709,007 | A * | 1/1998 | Chiang | 15/329 |
| 6,094,775 | A * | 8/2000 | Behmer | 15/329 |
| 7,113,847 | B2 * | 9/2006 | Chmura et al. | 700/245 |
| 2006/0179599 | A1 * | 8/2006 | Miner et al. | 15/320 |
| 2007/0006404 | A1 * | 1/2007 | Cheng et al. | 15/52.1 |
| 2007/0130717 | A1 * | 6/2007 | Yan | 15/319 |

FOREIGN PATENT DOCUMENTS

| | | | |
|---|---|---|---|
| DE | 19633336 | A1 * | 2/1998 |
| JP | 64-64613 | | 3/1989 |
| JP | 3-267032 | | 11/1991 |
| JP | 05056899 | A * | 3/1993 |
| JP | 10-14825 | | 1/1998 |
| JP | 2002-238816 | | 2/2002 |
| JP | 2003-180587 | | 7/2003 |
| JP | 2004351191 | A * | 12/2004 |
| JP | 2006271807 | A * | 10/2006 |
| JP | 2007-175196 | | 7/2007 |
| KR | 10-2004-037679 | | 5/2004 |

OTHER PUBLICATIONS

Office Action mailed on May 27, 2008 and issued in corresponding Korean Patent Application No. 2006-211304.3

* cited by examiner

*Primary Examiner*—David B Thomas
(74) *Attorney, Agent, or Firm*—Staas & Halsey LLP

(57) ABSTRACT

A robot cleaning system is capable of performing automatic cleaning and manual cleaning with a minimal number of devices. The robot cleaning system includes a first cleaning unit to perform automatic cleaning while moving by itself in an area to be cleaned, and a second cleaning unit to perform manual cleaning while being coupled to the first cleaning unit as it is moved by a user in an area to be cleaned. Each of the first and second cleaning units contains a blower and dust collector to vacuum. The first cleaning unit has a dust outlet to deliver dust to the second cleaning unit when the first cleaning unit is coupled to the second cleaning unit via the dust outlet of the first cleaning unit, a connector, and the connection port of the second cleaning unit.

12 Claims, 4 Drawing Sheets

ROBOT CLEANING SYSTEM

CROSS-REFERENCE TO RELATED APPLICATIONS

This application claims the benefit of Korean Patent Application No. 10-2006-0001922, filed on Jan. 6, 2006 in the Korean Intellectual Property Office, the disclosure of which is incorporated herein by reference.

BACKGROUND OF THE INVENTION

1. Field of the Invention

The invention relates to a cleaner, and, more particularly, to a robot cleaning system for enabling automatic cleaning using a robot cleaner as well as manual cleaning using labor of a user.

2. Description of the Related Art

A cleaner is a device for cleaning the room and is typically used to remove dust, dirt, and debris in a room. Generally used is a vacuum cleaner for collecting dust and loose debris by a suction force generated from a low-pressure unit. Recently, a robot cleaner, which is designed to remove dust and loose debris from the floor while moving on the floor via self-traveling and without manual operation, has been developed. Hereinafter, the term "automatic cleaning" refers to a cleaning operation performed by the robot cleaner that removes dust and loose debris while moving by itself, whereas the term "manual cleaning" refers to a cleaning operation performed by a person using a vacuum cleaner.

Although the robot cleaner is able to reduce the labor required for manual cleaning, the robot cleaner still has several limitations. Accordingly, solutions to improve the robot cleaner are receiving careful study. As one example of the solutions, Korean Patent Registration No. 10-459466 discloses a robot cleaner having an improved cleaning ability sufficient to clean dust in corners of a room.

In spite of the study, most current robot cleaners have the following several problems. Firstly, the automatic cleaning function of the cleaning robot is limited to the floor. The cleaning robot is not successful in automatic cleaning in other areas, for example, the surface of a sofa, shelf, or the like, and therefore, has a limited cleaning area. Secondly, the cleaning robot is smaller than a general vacuum cleaner, and is unable to generate a strong suction force, resulting in insufficient cleaning.

Due to the above-described problems of the cleaning robot, there still exists a need for a person to manually clean specific places with a general vacuum cleaner rather than the cleaning robot. A cleaning robot cannot reach all places. Additionally, manual cleaning is preferred over a cleaning robot because a cleaning robot lacks adequate power to sufficiently clean all areas.

Meanwhile, when using the robot cleaner, it is necessary to prepare a docking station, which is located at a specific place in a room. The docking station serves a dual purpose: to charge the rechargeable battery included in the robot cleaner and to remove dust and debris collected in the robot cleaner while the cleaning robot is docked.

Accordingly, a cleaning operation using both automatic cleaning and manual cleaning tools require the use of the cleaning robot, the docking station, and a general vacuum cleaner. This results in increased costs and reduces the amount of indoor space available.

SUMMARY OF THE INVENTION

Additional aspects and/or advantages of the invention will be set forth in part in the description which follows and, in part, will be apparent from the description, or may be learned by practice of the invention.

Therefore, the invention has been made in order to solve the above problems, and it is an aspect of the invention to provide a robot cleaning system capable of performing automatic cleaning and manual cleaning with a minimal number of devices.

It is another aspect of the invention to provide a robot cleaning system capable of removing dust and debris collected in a robot cleaner during manual cleaning.

In accordance with one aspect, the invention provides a robot cleaning system including: a first cleaning unit to perform automatic cleaning while moving by itself in an area to be cleaned; and a second cleaning unit to perform manual cleaning while being coupled to the first cleaning unit as it is moved by a user in an area to be cleaned.

The first cleaning unit may have a dust outlet to deliver dust, sucked or vacuumed thereinto, to the second cleaning unit when the first cleaning unit is coupled to the second cleaning unit, and the second cleaning unit may have a connection port corresponding to the dust outlet.

The robot cleaning system may further include a connector mounted in the first cleaning unit or second cleaning unit to connect the dust outlet to the connection port when the first cleaning unit is coupled to the second cleaning unit.

The dust outlet may be provided with a first opening/closing member to open the dust outlet only when the first cleaning unit is coupled to the second cleaning unit.

The first cleaning unit may include: a body; and a first dust collector mounted in the body to collect the dust vacuumed, wherein the dust outlet is connected to the first dust collector.

The first cleaning unit may include: a body; a first blower mounted in the body to provide power required to vacuum dust; and an outlet to discharge an air stream, generated by the first blower, to the outside of the body, and the outlet may be provided with a second opening/closing member to open and close the outlet.

The first cleaning unit may further include a rechargeable battery, and a display for the battery life of the rechargeable battery. The second cleaning unit includes a charger for the rechargeable battery when the first cleaning unit is coupled to the second cleaning unit, in order to charge the rechargeable battery.

The second cleaning unit may include: a body configured to connect the first cleaning unit when the first cleaning unit is coupled to the second cleaning unit; a second blower mounted in the body to provide the power required to vacuum dust; and a second dust collector to collect the dust delivered from the first cleaning unit through the dust outlet and the connection port.

In accordance with another aspect, the invention provides a robot cleaning system including: a first cleaning unit having a first blower and a first dust collector to vacuum and collect dust, the first cleaning unit being adapted to perform automatic cleaning while moving by itself in an area to be cleaned; and a second cleaning unit having a second blower and a second dust collector to vacuum and collect dust, the second cleaning unit being adapted to perform manual cleaning while being coupled to the first cleaning unit as it is moved by a user in an area to be cleaned.

The first cleaning unit may have: an inlet to vacuum dust from the floor of the area to be cleaned; a first suction channel to connect the inlet to the first dust collector; and a dust outlet that is connected to the first dust collector, so as to deliver the dust, collected in the first cleaning unit from the first suction channel, to the second cleaning unit when the first cleaning unit is coupled to the second cleaning unit.

The dust outlet may be provided with an opening/closing member to open the dust outlet only when the first cleaning unit is coupled to the second cleaning unit, whereby the dust is collected in the first dust collector by passing through the inlet and the first suction channel when the first cleaning unit performs automatic cleaning.

The second cleaning unit may have: a connection port to transport the dust delivered from the first cleaning unit to the second cleaning unit; and a second suction channel to connect the connection port to the second dust collector, whereby the dust is collected in the second dust collector by passing through the inlet, first suction channel, dust outlet, connection port, and second suction channel in this sequence when the first cleaning unit is coupled to the second cleaning unit.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings, of which.

DETAILED DESCRIPTION OF THE PREFERRED EMBODIMENTS

Figure 1:
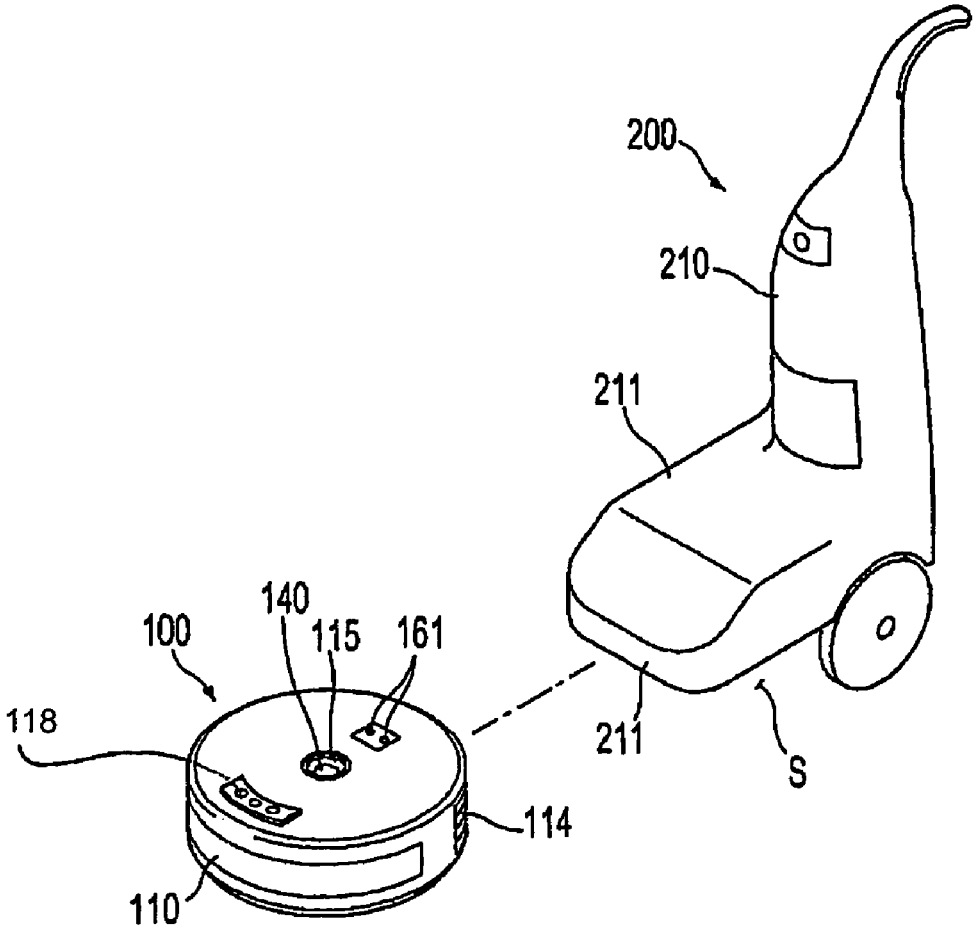
FIG. 1 is a perspective view showing the exterior of a robot cleaning system in accordance with the invention.

Reference will now be made in detail to the embodiment of the invention, examples of which is illustrated in the accompanying drawings, wherein like reference numerals refer to like elements throughout. The embodiment is described below to explain the invention by referring to the figures.

As shown in FIGS. 1 to 4, the robot cleaning system in accordance with the invention includes a first cleaning unit 100 to perform automatic cleaning while moving by itself in an area to be cleaned, and a second cleaning unit 200 to perform manual cleaning when it is coupled to the first cleaning unit 100. The first cleaning unit 100 serves as an independent robot cleaner, and the second cleaning unit 200 serves as a vacuum cleaner for manual cleaning when it is coupled to the first cleaning unit 100. When the first cleaning unit 100 is connected to the second cleaning unit 200, the second cleaning unit 200 utilizes the first cleaning unit 100 as a suction piece to vacuum dust and loose debris from the floor.

Figure 2:
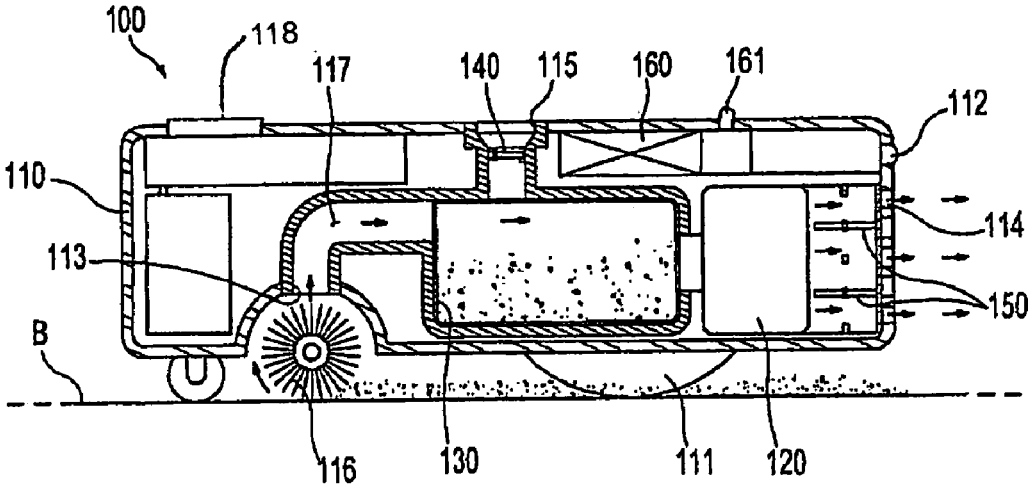
FIG. 2 is a side sectional view showing the configuration of a first cleaning unit of the robot cleaning system in accordance with the invention.

As shown in FIG. 2, the first cleaning unit 100 includes a body 110, a first blower 120 mounted in the body 110 to provide power required to vacuum dust and loose debris, and a first dust collector 130 mounted in the body 110 to collect the dust and debris that is vacuumed. Although not shown, the first blower 120 has a suction motor, and a fan that is rotated by the suction motor.

A pair of wheels 111 for moving the first cleaning unit 100 is provided at a bottom wall of the body 110. Each of the two wheels 111 is adapted to be selectively driven by a drive motor (not shown), to enable the first cleaning unit 100 to move in a desired direction. A camera 112 is provided on the outside of the body 110. The camera 112 serves to film images around the first cleaning unit 100, in order to determine the position of the first cleaning unit 100, and to recognize obstacles, such as walls or furniture, located around the first cleaning unit 100.

The first cleaning unit 100 has an inlet 113 formed at the bottom wall of the body 110 to vacuum dust and loose debris from the floor of an area to be cleaned, a first outlet 114 to discharge an air stream that is generated by the first blower 120 to the outside of the body 110, and a dust outlet 115 formed at a top wall of the body 110 to deliver the dust and debris into the second cleaning unit 200 when the first cleaning unit 100 is coupled to the second cleaning unit 200.

A brush 116 is rotatably mounted in the proximity of the inlet 113 of the body 110 to sweep up dust and loose debris from the floor B. A first suction channel 117 connects the inlet 113 and the first dust collector 130 and is located between the inlet 113 and the first dust collector 130.

The dust outlet 115 is used to communicate with both the first suction channel 117 and the first dust collector 130. The dust outlet 115 is provided with a first opening/closing member 140 to open the dust outlet 115 only when the first cleaning unit 100 is coupled to the second cleaning unit 200. Specifically, when the first cleaning unit 100 independently performs automatic cleaning, the first opening/closing member 140 closes the dust outlet 115 to allow the dust and debris vacuumed with the first suction channel 117 to remain in the first dust collector 130. Also, when the first cleaning unit 100 is coupled to the second cleaning unit 200 to perform manual cleaning, the first opening/closing member 140 opens the dust outlet 115 in order to guide the dust and debris collected in the first cleaning unit 100 into the second cleaning unit 200.

The first outlet 114 is provided with a second opening/closing member 150 to open and close the first outlet 114. When the first cleaning unit 100 independently performs automatic cleaning, the second opening/closing member 150 opens the first outlet 114 to allow an air stream that has passed through the first dust collector 130, to be discharged out of the body 110. Also, when the first cleaning unit 100 is coupled to the second cleaning unit 200 to perform manual cleaning, the second opening/closing member 150 closes the first outlet 114 to prevent the air stream from leaking through the first outlet 114.

The first cleaning unit 100 includes a rechargeable battery 160 to supply the power required to operate the first cleaning unit 100. The rechargeable battery 160 is connected to a charging terminal 161, which protrudes upward out of the body 110 in order to allow the rechargeable battery 160 to be charged by a commercial alternator when the first cleaning unit 100 is unattached or connected to the second cleaning unit 200. As shown in FIGS. 1 and 2, the first cleaning unit 100 includes a display 118. The display 118 is used to show the battery life of the rechargeable battery 160 and provide a menu for the user's settings for automatic cleaning.

Figure 3:
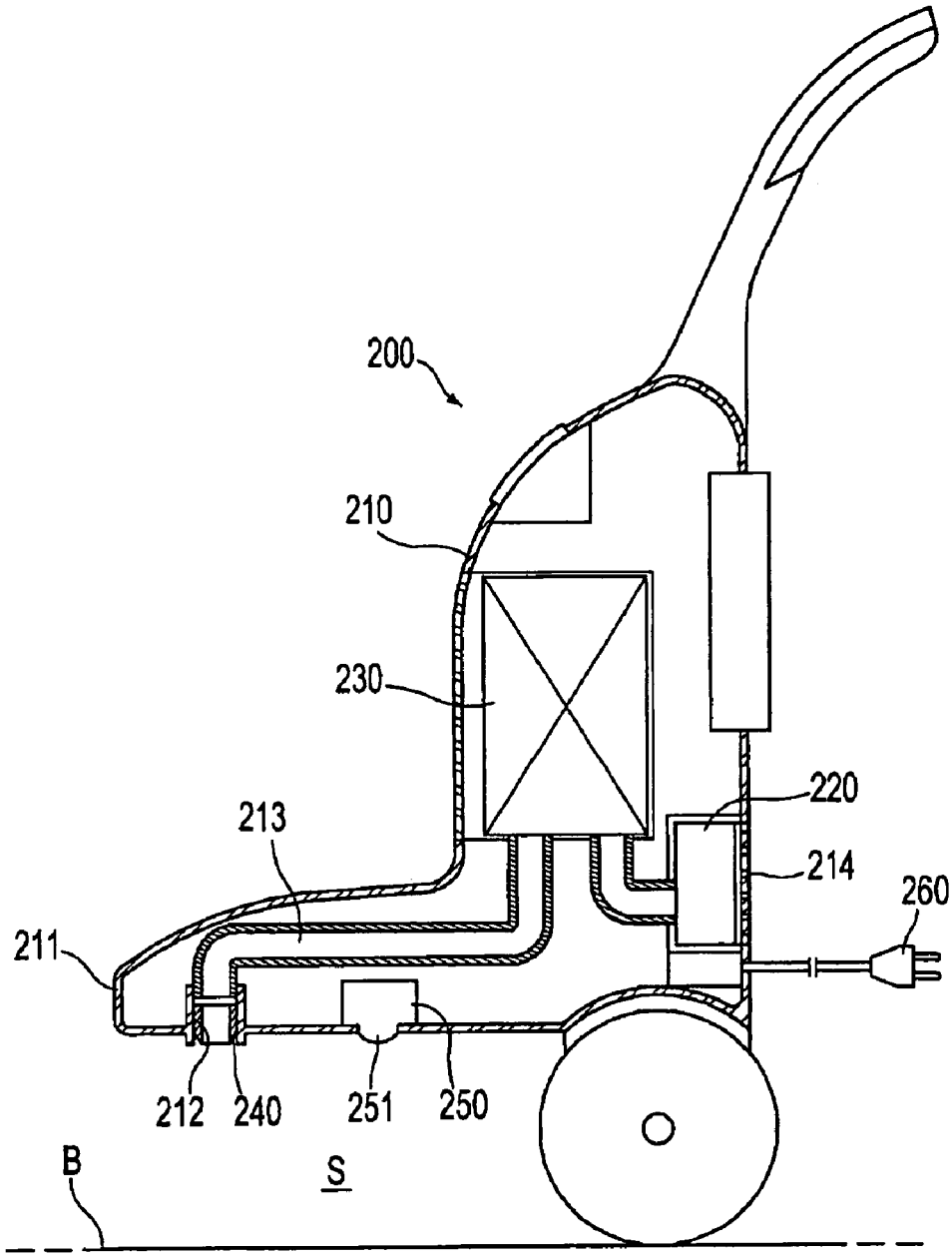
FIG. 3 is a side sectional view showing the configuration of a second cleaning unit of the robot cleaning system in accordance with the invention.
Figure 4:
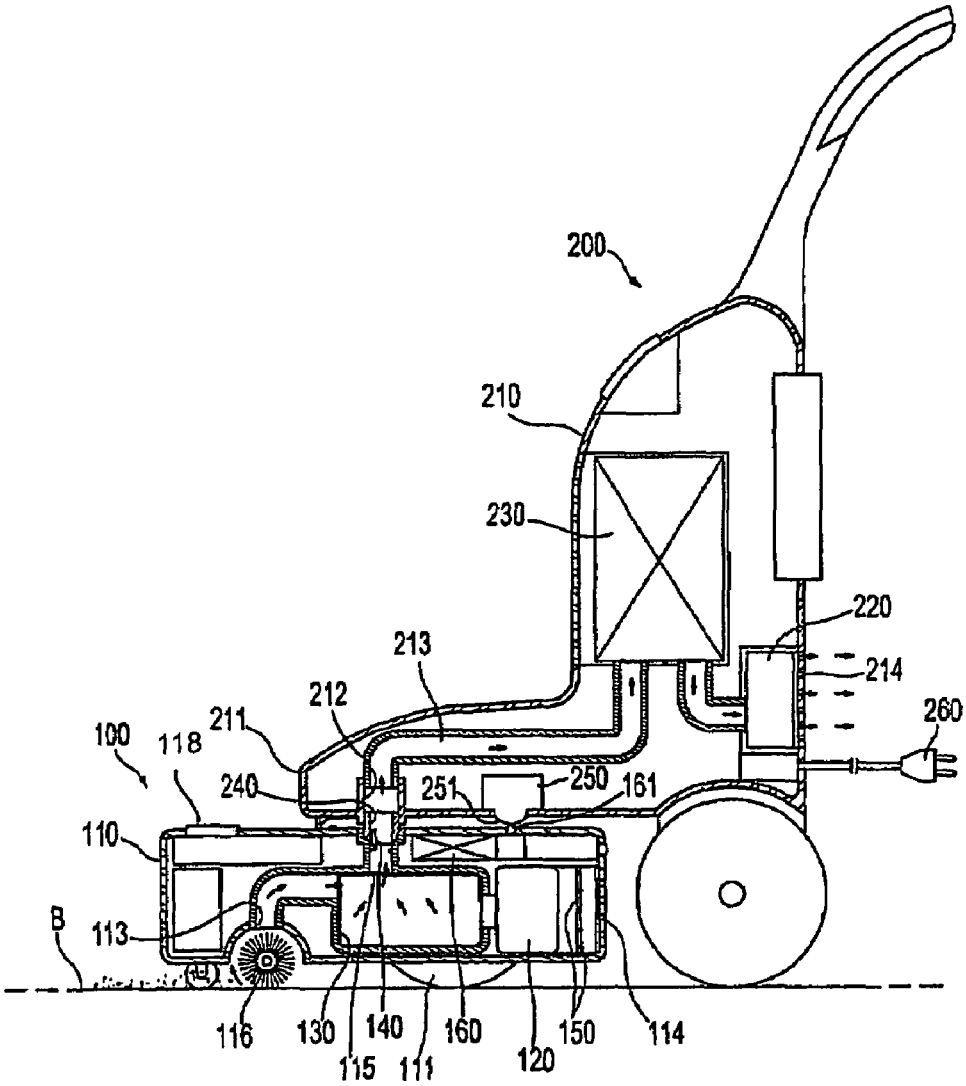
FIG. 4 is a side sectional view of the robot cleaning system in accordance with the invention, showing the first and second cleaning units, which are coupled to each other.

As shown in FIG. 3, the second cleaning unit 200 includes a body 210, a second blower 220 mounted in the body 210 to provide power required to vacuum dust and loose debris during manual cleaning, and a second dust collector 230 mounted in the body 210 to collect the dust and debris vacuumed. Here, the second dust collector 230 may be a dust envelope, or cyclone dust collector that is widely used for cleaning. Although not shown, the second blower 220 has a suction motor, and a fan to be rotated by the suction motor.

The body 210 of the second cleaning unit 200 has a protruding portion 211, which extends forward from a lower end of the body 210 to define a receiving space S, which is utilized to house the first cleaning unit 100. The protruding portion 211 is formed with a connection port 212 at a position corresponding to the dust outlet 115 when the first cleaning unit 100 is coupled to the second cleaning unit 200. The connection port 212 is used to transport the dust and debris from the first cleaning unit 100 to the second cleaning unit 200.

A connector 240 is fitted into the connection port 212 to connect the dust outlet 115 to the connection port 212 when the first cleaning unit 100 is coupled to the second cleaning unit 200. The connector 240 may be selected from a variety of different members used to connect the connection port 212 with the dust outlet 115 when the first cleaning unit 100 is coupled to the second coupling unit 200. In the present embodiment, the connector 240 is a movable tube mounted in the station body 210 that can extend vertically to couple the first cleaning unit 100 with the second coupling unit 200. For example, when the first cleaning unit 100 is coupled to the second cleaning unit 200, the movable tube partially protrudes downward out of the body 210 to connect the connection port 212 with the dust outlet 115 (See FIGS. 3 and 4). Alternatively, the connector 240 may be mounted in the first cleaning unit 100.

There is a second suction channel 213 between the connection port 212 and the second dust collector 230 in order to guide the dust and debris, transferred through the connection port 212, into the second dust collector 230. Also, a second outlet 214 is formed at a rear wall of the body 210 to discharge an air stream, generated by the second blower 220, to the outside of the body 210.

A charger 250 is mounted in the body 210 to charge the rechargeable battery 160 of the first cleaning unit 100. A power terminal 251 that is located on a side of the charger 250 is used to electrically connect the charger 250 to the charging terminal 161 when the first cleaning unit 100 is coupled to the second cleaning unit 200.

The second cleaning unit 200 has a power cord 260 to apply the electric power that is required for the operation of the second cleaning unit 200, or to supply electric power to the charger 250.

Hereinafter, the operation of the robot cleaning system associated with the subject of the invention will be explained. When automatic cleaning is performed by use of the first cleaning unit 100, the first cleaning unit 100 acts to vacuum and remove dust and loose debris from the floor B in an area that is automatically cleaned when the first cleaning unit 100 moves by itself. When the first cleaning unit 100 is used without the second cleaning unit 200, the first opening/closing member 140 of the first cleaning unit 100 closes the dust outlet 115, while the second opening/closing member 150 opens the first outlet 114. Accordingly, the dust and debris, vacuumed through the inlet 113 and the first suction channel 117, are collected in the first dust collector 130, and the vacuumed air is discharged out of the body 110 through the first outlet 114. Closing the dust outlet 115 prevents any dust or debris from escaping from the first dust collector 130 of the first cleaning unit 100.

To perform manual cleaning, the first cleaning unit 100 is coupled to the second cleaning unit 200. The first cleaning unit 100 is coupled to a lower region of the second cleaning unit 200, such that the second cleaning unit 200 utilizes the first cleaning unit 100 as a suction piece to vacuum the dust and loose debris from the floor B. When the first cleaning unit 100 is coupled to the second cleaning unit 200, the connection port 212 of the second cleaning unit 200 connects with the dust outlet 115 of the first cleaning unit 100 by use of the connector 240. The second opening/closing member 150 closes the first outlet 114 of the first cleaning unit 100. During manual operation, the first blower 120 is not operated, and only the second blower 220 operates. Thereby, the dust and debris that are vacuumed from the floor B of an area to be cleaned, pass through the inlet 113, first suction channel 117, dust outlet 115, connection port 212, and second suction channel 213 in this sequence, to be collected into the second dust collector 230. Simultaneously, the dust and debris, collected in the first dust collector 130, are delivered into the second dust collector 230 by passing through the dust outlet 115, connection port 212, and second suction channel 213. Transferring the dust and debris into the second dust collector 230 has the effect of emptying the first dust collector 130 of the first cleaning unit 100 automatically during the manual operation. Therefore, it is possible to reduce the inconvenience caused by the disposal of the dust and debris collected in the first dust collector 130, and to eliminate the need for a separate docking station required for each cleaning unit.

During the automatic cleaning using the first cleaning unit 100, the first cleaning unit 100 is coupled to the second cleaning unit 200 such that the charging terminal 161 of the first cleaning unit is connected to the power terminal 251 found on the second cleaning unit 200, the rechargeable battery 160 is automatically charged. In this case, the first cleaning unit 100 is not connected to the second cleaning unit 200 via the connector 240. The first cleaning unit 100 is connected to the second cleaning unit 200 using the connection port 212.

Although the present embodiment describes an example in that the first cleaning unit 100 includes the first blower 120 to remove dust and loose debris by suction, alternatively, a brush, which is rotated by a motor, may be used to sweep up the dust and loose debris.

The invention provides a robot cleaning system wherein a first cleaning unit 100 (i.e. robot cleaner) is used for automatic cleaning and can also be used to perform a manual cleaning operation, which improves the utility of the system. Also, according to the invention, dust and debris that was collected in the robot cleaner can be removed from the robot cleaner during manual operation. Thus, the cleaning convenience of the first cleaning unit is improved. Further, a second cleaning unit can be used as a charging device for the first cleaning unit. This eliminates a need for a separate docking system, which increases convenience in use and decreases costs. Accordingly, when compared to the conventional cleaning operation that requires a plurality of devices to perform both automatic cleaning and manual cleaning, the invention reduces costs and the space needed to store and operate the cleaning devices.

Although embodiments of the invention have been shown and described, it would be appreciated by those skilled in the art that changes may be made in this embodiment without departing from the principles and spirit of the invention, the scope of which is defined in the claims and their equivalents.

What is claimed is:

1. A robot cleaning system, comprising:

a first cleaning unit to perform automatic cleaning while moving by itself in an area to be cleaned; and a second cleaning unit to perform manual cleaning while being coupled to the first cleaning unit as it is moved by a user in an area to be cleaned, wherein the first cleaning unit includes body, a first blower mounted in the body to provide power required to suck dust, and an outlet to discharge an air stream, generated by the first blower, to the outside of the body; and the outlet is provided with a second opening/closing member to open and close the outlet.

2. A robot cleaning system, comprising:

a first cleaning unit to perform automatic cleaning while moving by itself in an area to be cleaned; and a second cleaning unit to perform manual cleaning while being coupled to the first cleaning unit as it is moved by a user in an area to be cleaned, wherein the first cleaning unit has a dust outlet to transport dust, dirt, and debris, vacuumed thereinto, to the second cleaning unit when the first cleaning unit is coupled to the second cleaning unit; and the second cleaning unit has a connection port corresponding to the dust outlet.

3. The robot cleaning system according to claim 2, further comprising:

a connector mounted in the first cleaning unit or the second cleaning unit to connect the dust outlet to the connection port when the first cleaning unit is coupled to the second cleaning unit.

4. The robot cleaning system according to claim 2, wherein the dust outlet is provided with a first opening/closing member to open the dust outlet only when the first cleaning unit is coupled to the second cleaning unit.

5. The robot cleaning system according to claim 2, wherein the first cleaning unit includes a body; and a first dust collector mounted in the body to collect the dust sucked, wherein the dust outlet communicates with the first dust collector.

6. The robot cleaning system according to claim 2, wherein the second cleaning unit includes:

a body configured to receive the first cleaning unit when the first cleaning unit is coupled to the second cleaning unit;

a second blower mounted in the body to provide power required to suck dust; and a second dust collector to collect the dust delivered from the first cleaning unit through the dust outlet and the connection port.

7. A robot cleaning system, comprising:

a first cleaning unit to perform automatic cleaning while moving by itself in an area to be cleaned; and a second cleaning unit to perform manual cleaning while being coupled to the first cleaning unit as it is moved by a user in an area to be cleaned, wherein the first cleaning unit further includes a rechargeable battery, and the second cleaning unit includes a charger to be electrically connected to the rechargeable battery when the first cleaning unit is coupled to the second cleaning unit, to charge the rechargeable battery.

8. A robot cleaning system, comprising:

a first cleaning unit having a first blower and a first dust collector to suck and collect dust, the first cleaning unit being adapted to perform automatic cleaning while moving by itself in an area to be cleaned; and a second cleaning unit having a second blower and a second dust collector to suck and collect dust, the second cleaning unit being adapted to perform manual cleaning while being coupled to the first cleaning unit as it is moved by a user in an area to be cleaned.

9. The robot cleaning system according to claim 8, wherein the first cleaning unit has: an inlet to suck dust from the floor of the area to be cleaned; a first suction channel to connect the inlet to the first dust collector; and a dust outlet to communicate with both the first suction channel and the first dust collector, so as to deliver the dust, collected in the first cleaning unit, to the second cleaning unit when the first cleaning unit is coupled to the second cleaning unit.

10. The robot cleaning system according to claim 9, wherein the dust outlet is provided with an opening/closing member to open the dust outlet only when the first cleaning unit is coupled to the second cleaning unit, whereby the dust is collected in the first dust collector by passing through the inlet and the first suction channel when the first cleaning unit performs automatic cleaning.

11. The robot cleaning system according to claim 9, wherein the second cleaning unit has: a connection port to receive the dust delivered from the first cleaning unit; and a second suction channel to connect the connection port to the second dust collector, wherein the dust is collected in the second dust collector by passing through the inlet, first suction channel, dust outlet, connection port, and second suction channel in this sequence when the first cleaning unit is coupled to the second cleaning unit.

12. The robot cleaning system according to claim 9, wherein the first cleaning unit further includes a rechargeable battery, and the second cleaning unit includes a charger to be electrically connected to the rechargeable battery when the first cleaning unit is coupled to the second cleaning unit, to charge the rechargeable battery.

* * * * *